United States Patent [19]

Brownlee

[11] Patent Number: 4,727,452

[45] Date of Patent: Feb. 23, 1988

[54] CONDUCTOR DEVICE FOR FOOTWEAR

[76] Inventor: William L. Brownlee, Box 4942, Berkeley, Calif. 94704

[21] Appl. No.: 882,507

[22] Filed: Jul. 7, 1986

[51] Int. Cl.[4] ..... H05F 3/02

[52] U.S. Cl. ..... 361/224; 361/220

[58] Field of Search ..... 361/88, 224, 220; 36/108, 69, 75 R, 66, 72 A

[56] References Cited

U.S. PATENT DOCUMENTS

| | | | |
|---|---|---|---|
| 1,728,167 | 9/1929 | Olmstead | 361/224 |
| 2,332,000 | 10/1943 | Murray | 12/142 |
| 2,606,333 | 8/1952 | Murray | 12/142 |
| 2,668,304 | 11/1948 | Murray | 12/142 |
| 2,733,522 | 2/1956 | Murray | 36/8.5 |
| 2,733,523 | 10/1952 | Murray | 36/8.5 |
| 3,274,442 | 9/1966 | Peel | 361/224 |
| 3,544,841 | 12/1967 | Peel | 361/224 |
| 4,389,448 | 6/1983 | Green | 428/195 |
| 4,513,347 | 4/1985 | Wilcox et al. | 361/212 |

*Primary Examiner*—A. D. Pellinen
*Assistant Examiner*—Todd E. DeBoer
*Attorney, Agent, or Firm*—Bielen & Peterson

[57] ABSTRACT

A thermal and electrical conductor device constructed for installation on footwear for eliminating heat and static effects particularly where the soles and heels of the footwear are fabricated of man-made materials, the conductor device comprising a first metallic disc installed on the outside surface of the bottom of the footwear, a second metallic disc installed on the inside surface of the bottom of the footwear and a metallic conducting member interconnecting the two metallic discs piercing the bottom of the footwear wherein the metal of the discs and interconnecting member has the characteristic of being electrically and thermally conductive.

2 Claims, 6 Drawing Figures

CONDUCTOR DEVICE FOR FOOTWEAR

BACKGROUND OF THE INVENTION

This invention relates to a device for improving the comfort of modern footwear, particularly footwear fabricated from man-made materials which insulate the user's foot thermally and electrically from the ground surface. The device is designed to be installed on footwear after manufacture of the footwear and may be separately sold and installed by the user.

It has been discovered that static buildup in wearers of insulating footwear can be eliminated by the use of an electrical conductor connecting the user to ground. The addition of a conducting wire of ribbon in the manufacture of shoes was taught by Murray in several patents of which U.S. Pat. No. 2,332,000, Issued Oct. 19, 1943, entitled, "Method Of Manufacturing Shoes" is apparently the most descript. While the soft conductor is disclosed for its heat reducing qualities in the cited patent, it is reported in the reference, "Get Well Naturally" by Linda Clark, (ARC Books 1971) at 285, that the shoes of Murray are "grounded" so that the wearer does not accumulate static electricity.

While a small wire or thread of conducting material is sufficient to eliminate static problems, it has been found inadequate for the problem of heat dissipation. Heat dissipation is greatly improved by a device that utilizes a substantially greater heat collecting area and complementary heat dissipating area. This is particularly important where man made, rubber-like soles are used which are particularly problematical in generating excessive heat.

Furthermore, use of a wire or flexible ribbon tended to result in failures from repeated flexure of the wire or ribbon during normal walking which severed contact from the internal end of the wire proximate the foot with the external end proximate the ground.

The improved static grounding and heat dissipating device of this invention solves the above problems and provides a unique fixture that can be added to a user's then owned footwear.

SUMMARY OF THE INVENTION

This invention relates to an improved static and thermal conductor device for footwear such as shoes and boots for dissipating heat and static electricity through the bottom of the footwear. The conductor device is constructed with a flat, top cap and a flat, bottom cap with an interconnecting shank.

Preferably the top cap and bottom cap are threadably interconnected by a shank. The preferred device includes a threaded screw member connected to a disc that is threadable engageable with a threaded shaft member connected to a second disc. The discs include means such as a slot or hex inset enabling the two members to be secured when the two members are installed from opposite sides of a drilled hole in the sole of the footwear.

Alternately, a nail-like member with a broad, flat head is engageable with a disc having punched engagement brackets. The brackets engage the portion of the nail shank that pierces the sole of a shoe when the nail is nailed through the bottom of the shoe. The brackets hold the shank against the flat surface of the disc. The disc is forced flat on the inside of the shoe against the sole, bending the shank and securing the disc and nail to the shoe.

Preferably one or more of the conductor devices are installed through the sole of each shoe or boot under the arch of the foot of the wearer where the conductor device will not cause any physical discomfort. These and other features will become apparent from a consideration of the detailed description of the preferred embodiments.

DETAILED DESCRIPTION OF THE PREFERRED EMBODIMENTS

Figure 1:
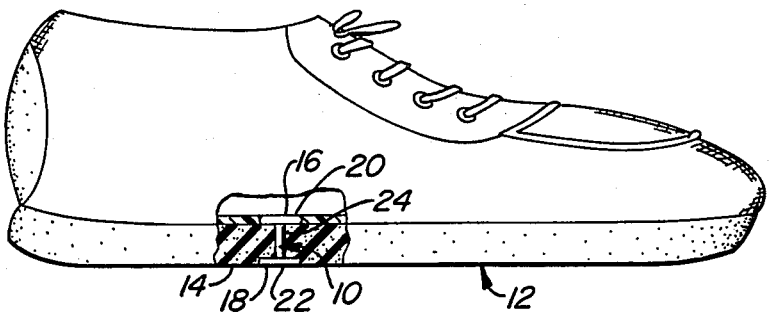
FIG. 1 is a side elevational view partially broken away with the conductor device installed in a shoe.

The improved static and thermal conductor device, designated generally by the reference numeral 10, is shown in FIG. 1, fixed to the bottom of a shoe 12. The shoe 12 comprises a typical footwear of the type used in combination with the conductor device. It is to be understood that other footwear such as sneakers, boots or the like may advantageously employ the addition of the conductor device, particularly where the sole is of a rubber-like, man-made material that is likely to be a insulator of both heat and static electricity when used as the sole for conventional footwear, such as a composition, while longer wearing and resilient, is likely to cause discomfort from hot feet and static discharge whenever the wearer touches a ground surface.

However, when a conductor device 10 as shown in FIG. 1 is installed through the resilient sole 14 of a shoe 12, such that a top surface 16 contacts the wearer's foot and a bottom surface 18 contacts the ground, the wearer is electrostatically grounded and his feet are cooled. While a small wire is suitable for grounding, so long as contact is made, the likelihood of which diminishes as the wire wears, it is necessary that large heat collecting and heat dissipating surfaces be employed for effective cooling. It has been found that a surface the size of a penny is exceptionally effective for this function. The conductor device comprises a top disc member 20, a bottom disc member 22 and an interconnecting shank 24.

Figure 2:
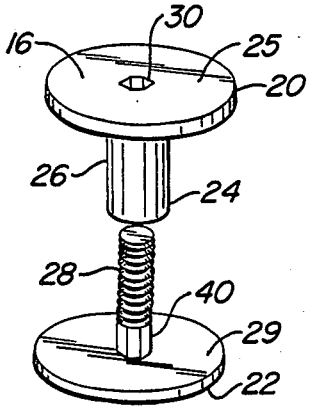
FIG. 2 is an exploded view of one embodiment of the conductor device.
Figure 3:
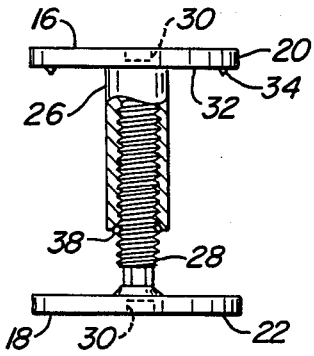
FIG. 3 is a side elevational view, partially in cross section,of the conductor device of FIG. 1.
Figure 4:
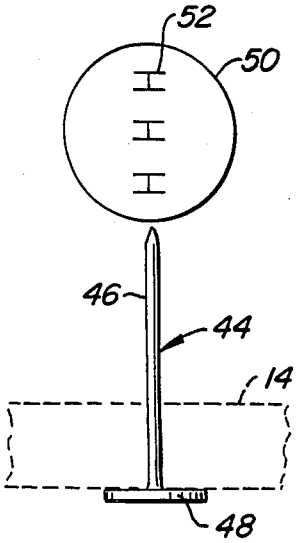
FIG. 4 is an exploded view of an alternate embodiment of the conductor device.

In the embodiment of FIGS. 2 and 3, the top disc member 20 of the conductor device 10 is constructed with a cap 25 having a projecting neck 26 that is internally threaded. The neck 26 engages a projecting threaded post 28 on a cap 29 of the bottom disc member 22 that is internally threaded. The neck 26 engages a projecting threaded post 28 on the bottom disc member 22. A hole is drilled through the sole of the shoe slightly smaller than the projecting neck 26, which is forced into the hole from the inside of the shoe flexing the resilient material of the sole to provide a seal. The bottom disc member 22 is threaded into the neck of the top disc member 20 and tightened such that the resilient material of the sole is slightly compressed and the top surface 16 and bottom surface 18 of the disc members are flush or recessed relative to the top inside and bottom outside surface of the sole. In this manner the conductor device is virtually undetectable to the wearer, particularly when the device is located under the wearer's arch away from the heel or ball of the foot.

To aid in threading the bottom member 22 to the top member 20, each member includes a hex socket 30 which is engageable by a conventional Allen wrench. Further, the underside 32 of the top disc member 20 includes small prongs 34, which engage the surface of the sole liner 36 and restrict rotation. A nylon collar 38 in the end of the threaded neck 26 acts as a lock mechanism to prevent loosening of the engaged parts in the manner of a conventional aircraft nut. As an added feature the post 28 of the bottom member 22 has a hex throat 40 which allows the post to be removed from the neck 26 by a socket tool if the bottom cap 29 has worn off, enabling a replacement disc member to be easily installed.

Figure 5:
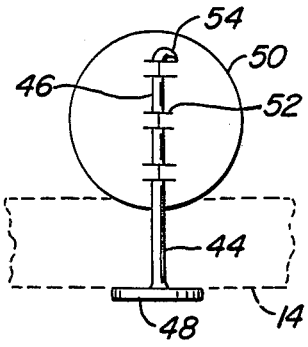
FIG. 5 is a side elevational view of the conductor device of FIG. 4.
Figure 6:
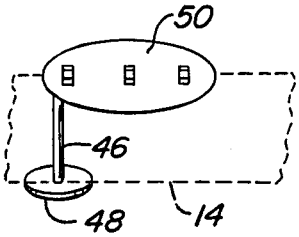
FIG. 6 is a side perspective view of the conductor device of FIG. 4.

As shown in FIGS. 3–6, an alternate embodiment of the conductor device uses a simplified construction to permit installation with a hammer and pliar. A nail 44 with a slender shank 46 and a broad head 48 is hammered up through the sole 14 of the footwear shown in dotted line. A flat disc 50 with a series of punched brackets 52 engages the portion of the nail shank that projects through the sole and holds the shank against the disc. The end 54 the nail is crimped as shown in FIG. 5 to prevent the disc 50 from slipping off the nail. The disc is then forced flat against the inside surface of the sole bending the nail as shown in FIG. 6. The flat disc 50 covers the nail and minimizes detection of the conductor device by the user.

In the embodiments shown the conductor device is fabricated from a highly conductive material such as copper or brass. The conductor device includes a flat top disc connected to a flat bottom disc by a connector that is preferably of the same conducting material as the discs, but of substantially smaller cross sectional area.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An improved thermal and static conducting device used in conventional footwear having a bottom sole comprising:

a top disc member having a face with shank engagement means positionable against the top surface of a footwear sole and a bottom disc member positionable on the bottom surface of a footwear sole and an interconnecting bendable shank passable through a footwear sole electrically interconnecting the top disc member to the bottom disc member wherein said disc members and said bendable shank are constructed of a thermally and electrically conducting material, and wherein said bendable shank is vertically connected to substantially the center of the bottom disc member, the shank being projectable up through a footwear sole and engageable against the face of the top disc member in the shank engagement means, wherein on installation on conventional footwear the shank is bent to position the top disc member face against the top surface of a footwear sole parallel to the bottom disc member when the bottom disc member is positioned against the bottom surface of a footwear sole.

2. The improved conducting device of claim 1 wherein said engagement means comprise a plurality of bracket elements punched in said top disc.

* * * * *